US008350457B2

(12) United States Patent
Thomas et al.

(10) Patent No.: US 8,350,457 B2
(45) Date of Patent: Jan. 8, 2013

(54) PRE-CHAMBER SPARK PLUG INCLUDING A GAS THREAD CAVITY

(75) Inventors: Christopher Thomas, Oakland, MI (US); Jeongung Hwang, Northville, MI (US); Nicholas C. Polcyn, Commerce, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 13/076,574

(22) Filed: Mar. 31, 2011

(65) Prior Publication Data

US 2012/0248964 A1 Oct. 4, 2012

(51) Int. Cl.
*H01T 13/40* (2006.01)
*H01T 13/20* (2006.01)
*F02P 13/00* (2006.01)

(52) U.S. Cl. ..... 313/143; 123/260; 123/143 R

(58) Field of Classification Search ..... 313/118, 313/120, 143; 123/260, 143 B, 266
See application file for complete search history.

(56) References Cited

U.S. PATENT DOCUMENTS

| | | | | | |
|---|---|---|---|---|---|
| 1,945,870 | A | * | 2/1934 | Stephenson | 313/143 |
| 3,926,169 | A | * | 12/1975 | Leshner et al. | 123/297 |
| 4,416,228 | A | * | 11/1983 | Benedikt et al. | 123/268 |
| 4,452,189 | A | * | 6/1984 | Latsch et al. | 123/143 B |
| 4,513,708 | A | * | 4/1985 | Latsch et al. | 123/263 |
| 4,982,070 | A | | 1/1991 | Bezin et al. | |
| 4,987,868 | A | | 1/1991 | Richardson | |
| 5,799,637 | A | * | 9/1998 | Cifuni | 123/266 |
| 6,013,973 | A | * | 1/2000 | Sato | 313/143 |
| 6,460,506 | B1 | | 10/2002 | Nevinger | |
| 7,104,246 | B1 | * | 9/2006 | Gagliano et al. | 123/266 |
| 2008/0174221 | A1 | * | 7/2008 | Tinwell | 313/141 |

FOREIGN PATENT DOCUMENTS

DE 10144976 4/2003

* cited by examiner

*Primary Examiner* — Karabi Guharay
(74) *Attorney, Agent, or Firm* — Harness, Dickey & Pierce, P.L.C.

(57) ABSTRACT

A spark plug includes a housing, a center electrode, a ground electrode, and a pre-chamber cup. The housing is configured to thread into a spark-plug hole in an engine. The center electrode extends axially from a center of the housing. The ground electrode extends radially inward from the housing. The pre-chamber cup is attached to the housing. The housing defines a gas thread cavity that extends radially at least partially through the housing.

19 Claims, 5 Drawing Sheets

PRE-CHAMBER SPARK PLUG INCLUDING A GAS THREAD CAVITY

FIELD

The present disclosure relates to spark plugs, and more particularly, to pre-chamber spark plugs including gas thread cavities.

BACKGROUND

This section provides background information related to the present disclosure which is not necessarily prior art.

A spark plug typically includes a housing configured to thread into a spark-plug hole of an engine, a center electrode extending axially from the center of the housing, and a ground electrode extending radially inward from the housing. When the spark plug is installed in the engine, the center electrode and the ground electrode are exposed to gas within a cylinder of the engine. The spark plug generates a flame kernel between the center electrode and the ground electrode, and the resulting flame is propagated through the cylinder.

A pre-chamber spark plug includes a pre-chamber cup attached to the housing and enclosing the center electrode and the ground electrode. During an intake stroke, unburned gas flows through one or more orifices extending axially through the bottom surface of the pre-chamber cup. At combustion, the pre-chamber spark plug ignites the unburned gas by generating a spark between the center electrode and the ground electrode. During a power stroke, a flame jet resulting from the spark flows through the orifices and ignites unburned gas within the cylinder outside of the pre-chamber spark plug.

SUMMARY

This section provides a general summary of the disclosure, and is not a comprehensive disclosure of its full scope or all of its features.

A spark plug includes a housing, a center electrode, a ground electrode, and a pre-chamber cup. The housing is configured to thread into a spark-plug hole in an engine. The center electrode extends axially from a center of the housing. The ground electrode extends radially inward from the housing. The pre-chamber cup is attached to the housing. The housing defines a gas thread cavity that extends radially at least partially through the housing.

The gas thread cavity may extend completely through the housing.

The gas thread cavity may include N cylindrical cavities equally spaced around a perimeter of the housing, where N is an integer greater than one (e.g., four).

The gas thread cavity may be configured to contain burned gas present within the housing when a spark is generated between the center electrode and the ground electrode.

The center electrode may have a first end and a second end opposite from the first end, and the center electrode may include a main body portion and a tip. The main body portion may extend from the first end to the tip. The tip may extend from the main body portion to the second end.

The main body portion of the center electrode may have a first height, and the gas thread cavity may have a second height that is approximately equal to the first height.

The second height of the gas thread cavity may be axially aligned with the first height of the main body portion of the center electrode.

The housing and the pre-chamber cup may define a chamber volume, and the center electrode and the ground electrode may be disposed within one-half of the chamber volume.

The center electrode and the ground electrode may be disposed within one-third of the chamber volume.

The housing may define a secondary gas cavity in fluid communication with the gas thread cavity, the secondary gas cavity extending radially into the housing without extending through an inner surface of the housing.

The gas thread cavity may have a U-shaped profile.

The gas thread cavity and the secondary gas cavity may be axially aligned with the center electrode and at least a portion of the ground electrode.

The gas thread cavity and the secondary gas cavity may be configured to contain burned gas present within the housing when a spark is generated between the center electrode and the ground electrode.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
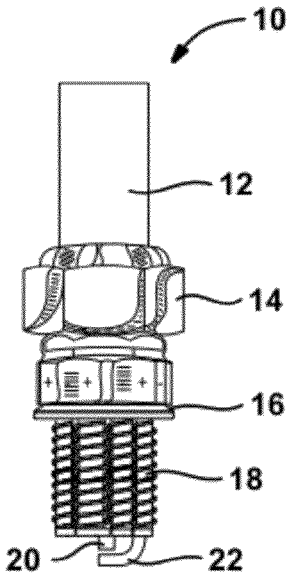
FIG. 1A Prior Art
FIG. 1A is a side view of a spark plug according to the prior art.

Referring to FIG. 1A, a spark plug 10 according to the prior art includes an insulator 12, a hex head 14, a gasket 16, a housing 18, a center electrode 20, and a ground electrode 22. The insulator 12 surrounds a terminal (not shown) connecting a spark plug wire (not shown) to the center electrode 20. A socket wrench is placed over the hex head 14 to loosen and tighten the spark plug 10 within a spark-plug hole in a cylinder head of an engine (not shown). The gasket 16 compresses against the cylinder head to seal the spark-plug hole.

Figure 1B:
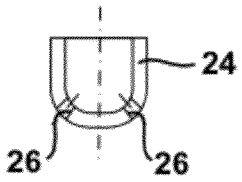
FIG. 1B Prior Art
FIG. 1B is a sectional view of a pre-chamber cup according to the prior art.

The housing 18 is configured to thread into the spark-plug hole. For example, the housing 18 may include external threads sized to mesh with internal threads in the spark-plug hole. The center electrode 20 extends axially from the center of the housing 18. The ground electrode 22 extends radially inward from the housing 18. When the spark plug 10 is installed in the spark-plug hole, the center electrode 20 and the ground electrode 22 are exposed to gas within the cylinder. The spark plug 10 generates a flame kernel between the center electrode 20 and the ground electrode 22, and the resulting flame propagates through the cylinder. Referring to FIG. 1B, a pre-chamber cup 24 according to the prior art defines one or more orifices 26 that extend axially through the bottom surface of the pre-chamber cup 24.

Figure 1C:
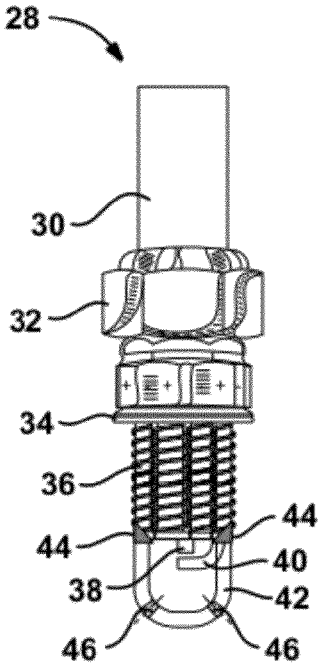
FIG. 1C Prior Art
FIG. 1C is a side view of a spark plug according to the prior art and a sectional view of a pre-chamber cup welded to the spark plug according to the prior art.

Referring to FIG. 1C, a pre-chamber spark plug 28 according to the prior art includes an insulator 30, a hex head 32, a gasket 34, a housing 36, a center electrode 38, a ground electrode 40, and a pre-chamber cup 42. The insulator 30 surrounds a terminal (not shown) connecting a spark plug wire (not shown) to the center electrode 38. A socket wrench is placed over the hex head 32 to loosen and tighten the pre-chamber spark plug 28 within a spark-plug hole in a cylinder head of an engine (not shown). The gasket 34 compresses against the cylinder head to seal the spark-plug hole.

The housing 36 is configured to thread into the spark-plug hole. The center electrode 38 extends axially from the center of the housing 36. The ground electrode 40 extends radially inward from the housing 36. The pre-chamber spark plug 28 generates a flame kernel between the center electrode 38 and the ground electrode 40, and the resulting flame propagates through the cylinder.

The pre-chamber cup 42 is attached to the housing 36 using a weld 44 and the pre-chamber cup 42 encloses the center electrode 38 and the ground electrode 40. During an intake stroke, unburned gas flows through one or more orifices 46 extending axially through the bottom surface of the pre-chamber cup 42. At combustion, the pre-chamber spark plug 28 ignites the unburned gas by generating a spark between the center electrode 38 and the ground electrode 40. During a power stroke, a flame jet resulting from the spark flows through the orifices 46 and ignites unburned gas within the cylinder outside of the pre-chamber spark plug 28.

Figure 1D:
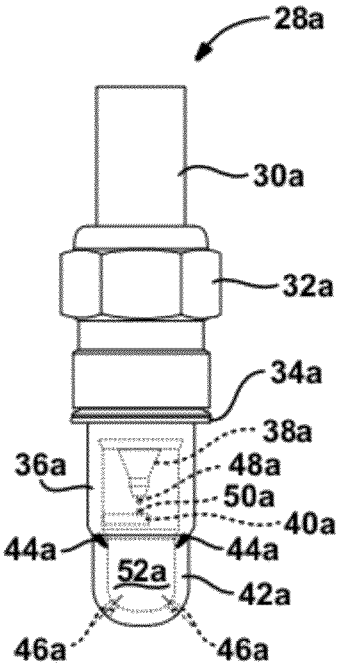
FIG. 1D Prior Art
FIG. 1D is a side view of a pre-chamber spark plug according to the prior art.

Referring to FIG. 1D, a pre-chamber spark plug 28*a* according to the prior art is substantially similar to the pre-chamber spark plug 28. Thus, only additional or different features shown in FIG. 1D are described. The center electrode 38*a* includes a tip 48*a* and the ground electrode 40*a* includes a tip 50*a*. The center electrode 38*a* and the ground electrode 40*a* are shifted axially upward relative the center electrode 38 and the ground electrode 40.

The inner surfaces of the housing 36*a* and the pre-chamber cup 42*a*, and the outer surfaces of the center electrode 38*a* and the ground electrode 40*a*, define a chamber 52*a*. Since the center electrode 38*a* and the ground electrode 40*a* are shifted axially upward, the volume of the chamber 52*a* in the pre-chamber spark plug 28*a* is greater than the volume of the chamber in the pre-chamber spark plug 28. The size of the center electrode 38*a* and the ground electrode 40*a* may also be reduced to increase the volume of the chamber 52*a*.

Figure 2A:
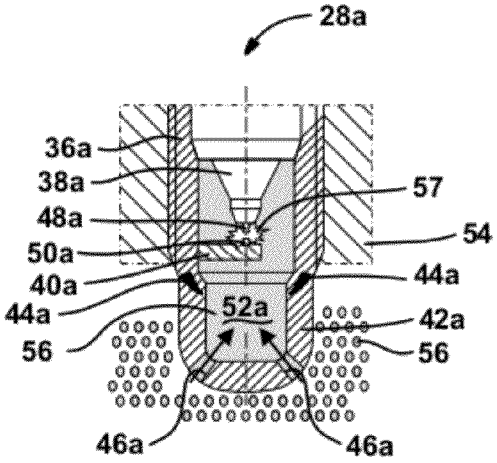
FIG. 2A Prior Art
FIG. 2A is a sectional view of a portion of a pre-chamber spark plug according to the prior art generating a first spark.

Referring to FIG. 2A, the pre-chamber spark plug 28*a* is shown installed in an engine 54. During an initial intake stroke of the engine 54, unburned gas 56 flows into the chamber 52*a* through the orifices 46*a*. At combustion, the pre-chamber spark plug 28*a* ignites the unburned gas 56 in the chamber 52*a* by generating a spark 57 between the center electrode 38*a* and the ground electrode 40*a*.

Figure 2B:
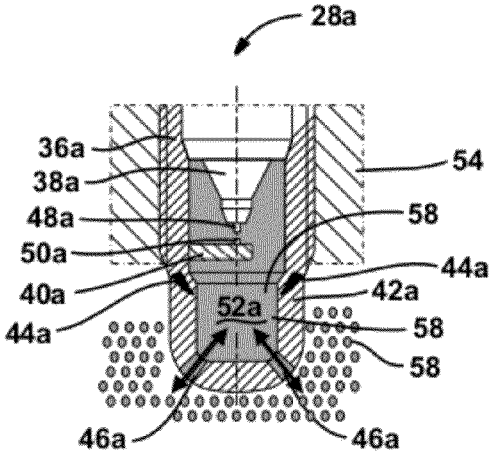
FIG. 2B Prior Art
FIG. 2B is a sectional view of a portion of a pre-chamber spark plug according to the prior art during a power stroke.

With additional reference to FIG. 2B, a flame jet resulting from the spark 57 propagates through the chamber 52*a* and the orifices 46*a*, and a resulting flame propagates through the cylinder, combusting the unburned gas 56 and leaving burned gas 58 in the cylinder. During a power stroke of the engine 54, this combustion increases the pressure in the cylinder, driving a piston (not shown) within the cylinder to produce torque. During an exhaust stroke of the engine 54, a portion of the burned gas 58 is drawn from the chamber 52*a*.

Figure 2C:
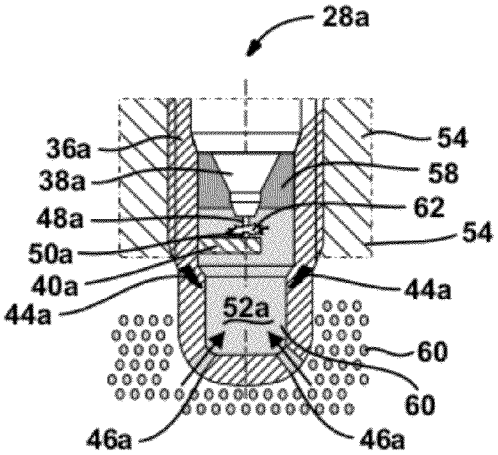
FIG. 2C Prior Art
FIG. 2C is a sectional view of a portion of a pre-chamber spark plug according to the prior art generating a second spark.

Referring to FIG. 2C, during a subsequent intake stroke of the engine 54, a portion of the burned gas 58 remains in the chamber 52*a* when unburned gas 60 flows into the chamber 52*a* through the orifices 46*a*. At combustion, the pre-chamber spark plug 28*a* ignites the unburned gas 60 in the chamber 52*a* by generating a spark 62 between the center electrode 38*a* and the ground electrode 40*a*.

Figure 3:
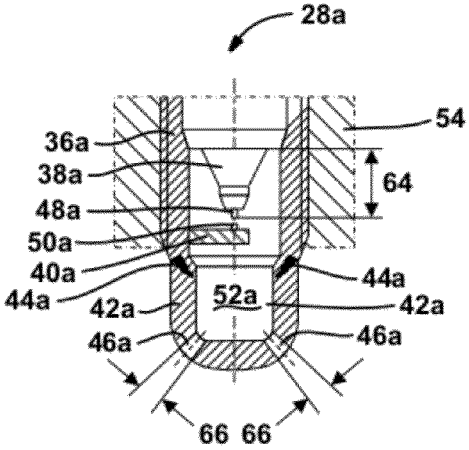
FIG. 3 Prior Art
FIG. 3 is a sectional view of a portion of a pre-chamber spark plug according to the prior art having a first spark position.

Referring to FIG. 3, factors that affect the combustion efficiency of the pre-chamber spark plug 28*a* include spark position, chamber volume, and orifice diameter. The spark position is indicated by a distance 64 from the upper end of the chamber 52*a* to the lower end of the tip 48*a* of the center electrode 38*a*. The chamber volume is the volume of the chamber 52*a*. The orifice diameter is one or more diameters 66 of the one or more orifices 46*a*.

Figure 4A:
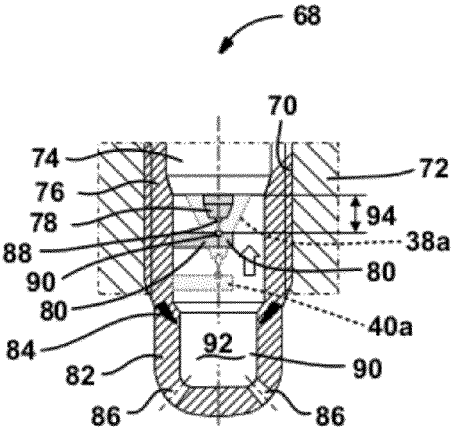
FIG. 4A is a sectional view of a portion of a pre-chamber spark plug according to the present disclosure having a second spark position.

Referring to FIG. 4A, a pre-chamber spark plug 68 according to the present disclosure is shown installed in a spark-plug hole 70 of an engine 72. The engine 72 may be a spark-ignition engine such as a natural gas engine. Natural gas engines require spark plugs having a long durability life and high ignitability to achieve high combustion efficiency and low emissions. The pre-chamber spark plug 68 may be designed to satisfy these requirements.

The pre-chamber spark plug 68 includes a terminal 74, a housing 76, a center electrode 78, a ground electrode 80, and a pre-chamber cup 82. The terminal 74 connects a spark plug wire (not shown) to the center electrode 78. The housing 76 is configured to thread into the spark-plug hole 70. For example, the housing 76 may include external threads sized to mesh with internal threads in the spark-plug hole 70.

The center electrode 78 extends axially from the center of the housing 76. The ground electrode 80 extends radially inward from the housing 76. The pre-chamber cup 82 is attached to the housing 76 using a weld 84, which may be a laser weld. The pre-chamber cup 82 encloses the center electrode 78 and the ground electrode 80, and defines one or more orifices 86 extending axially through the bottom surface of the pre-chamber cup 82. The center electrode 78 includes a tip 88 and the ground electrode 80 includes a tip 90. The inner surfaces of the housing 76 and the pre-chamber cup 82 define a chamber 92.

The height of the center electrode 78 of the pre-chamber spark plug 68 is less than the height of the center electrode 38*a* of the pre-chamber spark plug 28*a* of FIG. 3. As a result, the spark position of the pre-chamber spark plug 68, indicated by a distance 94, is different from the spark position of the pre-chamber spark plug 28*a*, indicated by the distance 64, as the distance 94 is less than the distance 64. To illustrate this, the center electrode 38*a* and the ground electrode 40*a* of the pre-chamber spark plug 28*a* are shown in dashed lines. Due to the distance 94, the center electrode 78 and the ground electrode 80 are disposed within one-half or less (e.g., one-third) of the chamber volume.

Due to the differences between the spark positions of the pre-chamber spark plugs 28*a*, 68, the volume of the chamber 92 in the pre-chamber spark plug 68 is greater than the volume of the chamber 52*a* in the pre-chamber spark plug 28*a*. As a result, the flame jet speed of the pre-chamber spark plug 68 is greater than the flame jet speed of the pre-chamber spark plug 28*a*. This may improve the combustion efficiency of the engine 72.

Figure 4B:
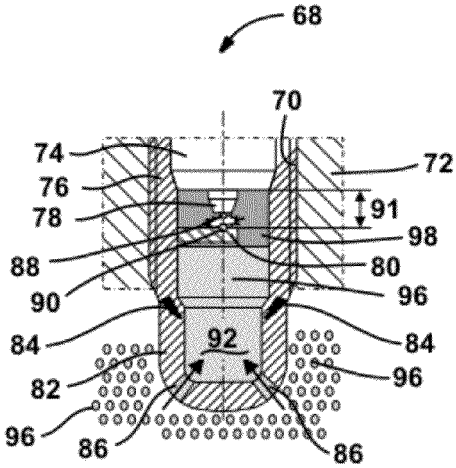
FIG. 4B is a sectional view of a portion of a pre-chamber spark plug according to the present disclosure generating a spark.

Referring to FIG. 4B, unburned gas 96 flows into the chamber 92 through the orifices 86 during an intake stroke. As the unburned gas 96 enters the chamber 92, the chamber 92 may contain burned gas 98 remaining from a prior combustion event. Thus, at combustion, the center electrode 78 and the ground electrode 80 may be encompassed by the burned gas 98, and therefore may be unable to ignite the unburned gas 96, resulting in a misfire.

Figure 5A:
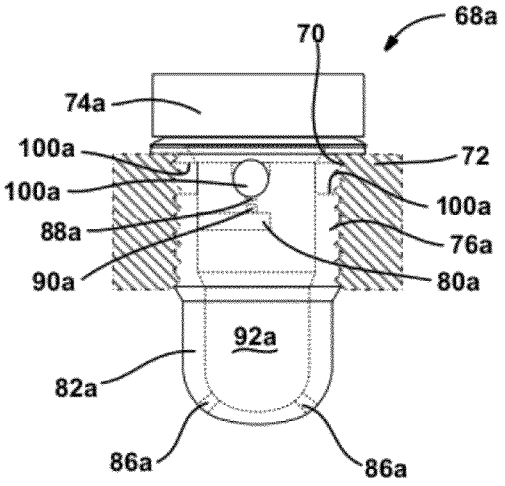
FIG. 5A is a side view of a pre-chamber spark plug including a gas thread cavity according to the present disclosure.

Referring to FIGS. 5A though 5D, a pre-chamber spark plug 68*a* according to the present disclosure is similar to the pre-chamber spark plug 68. Thus, only additional or different features are described. The housing 76*a* of the pre-chamber spark plug 68*a* defines a gas thread cavity 100*a* that extends radially through the housing 76*a*. The gas thread cavity 100*a* is configured to contain burned gas present within the housing 76*a* when a spark 101*a* is generated between the center electrode 78*a* and the ground electrode 80*a*.

Figure 5B:
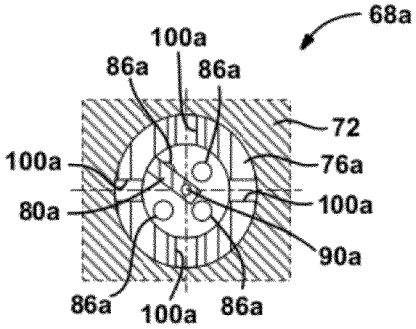
FIG. 5B is a bottom view of a pre-chamber spark plug including a gas thread cavity according to the present disclosure.
Figure 5C:
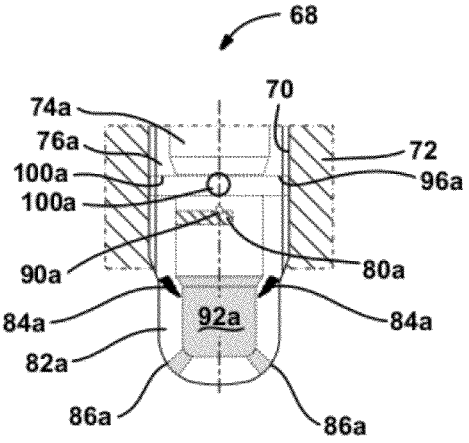
FIG. 5C is a sectional view of a portion of a pre-chamber spark plug including a gas thread cavity according to the present disclosure.

The gas thread cavity 100*a* may include multiple (e.g., four) cylindrical cavities that extend completely through the housing 76*a*, as shown. The cylindrical cavities may be 2 millimeters (mm) to 5 mm in diameter. Alternatively, the gas thread cavity 100*a* may include non-cylindrical cavities, and the cylindrical or non-cylindrical cavities may extend only partially through the housing 76*a*. In addition, the cylindrical or non-cylindrical cavities may be equally spaced around the perimeter of the housing 76*a*, as best shown in FIG. 5B.

The center electrode 78*a* may only include a main body portion and the tip 90*a*, and the height of the gas thread cavity 100*a* may be approximately equal to the height of the main body portion, as shown. Additionally, the height of the gas thread cavity 100*a* may be axially aligned with the height of the main body portion, as shown. In various embodiments, the height of the gas thread cavity 100*a* may be different and/or axially offset from the height of the main body portion of the center electrode 78*a*.

Figure 5D:
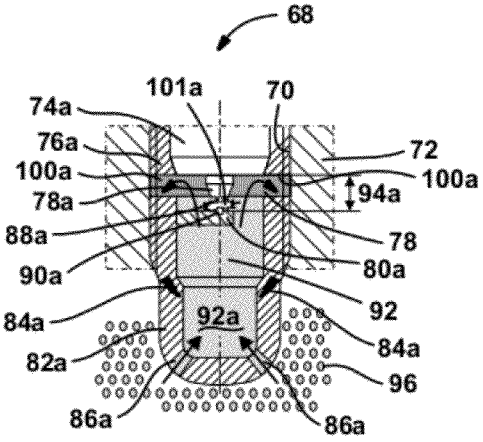
FIG. 5D is a sectional view of a portion of a pre-chamber spark plug including a gas thread cavity according to the present disclosure, the spark plug generating a spark.

As best shown in FIG. 5D, the unburned gas 96 flows into the chamber 92*a* through the orifices 86*a* during an intake stroke. As the unburned gas 96 enters the chamber 92*a*, the unburned gas 96 forces the burned gas 98 toward the upper end of the chamber 92*a* and into the gas thread cavity 100*a*. Thus, at combustion, the center electrode 78*a* and the ground electrode 80*a* are encompassed by the unburned gas 96, and therefore ignite the unburned gas 96. In this manner, the gas thread cavity 100*a* prevents misfires that may otherwise occur due to the spark position of the pre-chamber spark plug 68*a*, and improvements in combustion efficiency due to the spark position may be realized.

Referring to FIGS. 6A through 6D, a pre-chamber spark plug 68*b* according to the present disclosure is similar to the pre-chamber spark plug 68*a*. Thus, only additional or different features shown in FIG. 5A are described. The pre-chamber spark plug 68*b* defines a secondary gas cavity 102*b* in fluid communication with the gas thread cavity 100*b* and extending radially into the housing 76*b* without extending though an inner surface of the housing 76*b*.

Figure 6A:
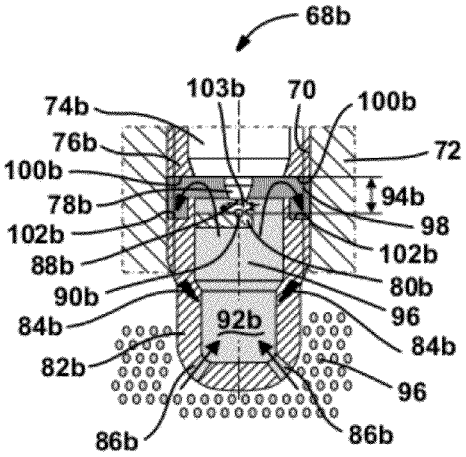
FIG. 6A is a sectional view of a portion of a pre-chamber spark plug including a gas thread cavity and a secondary gas cavity according to the present disclosure, the spark plug generating a spark.
Figure 6B:
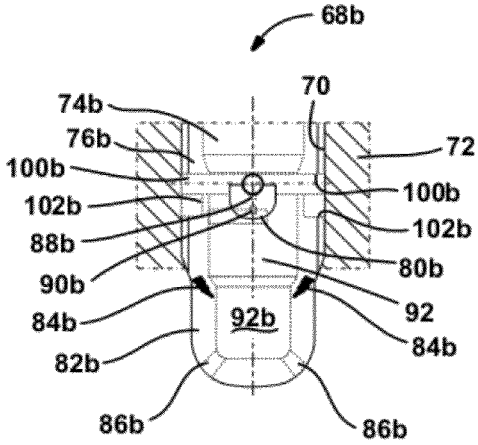
FIG. 6B is a sectional view of a portion of a pre-chamber spark plug including a gas thread cavity and a secondary gas cavity according to the present disclosure during an intake stroke.
Figure 6C:
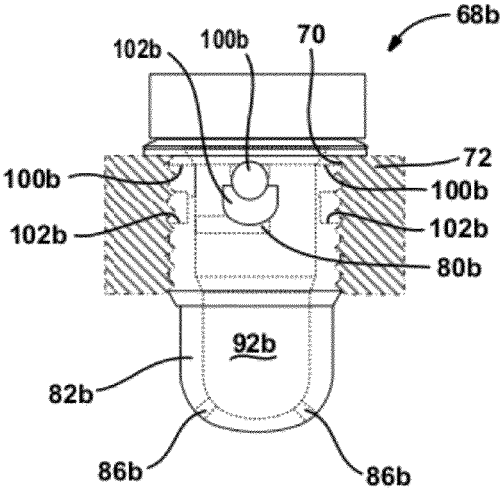
FIG. 6C is a side view of a portion of a pre-chamber spark plug including a gas thread cavity and a secondary gas cavity according to the present disclosure.
Figure 6D:
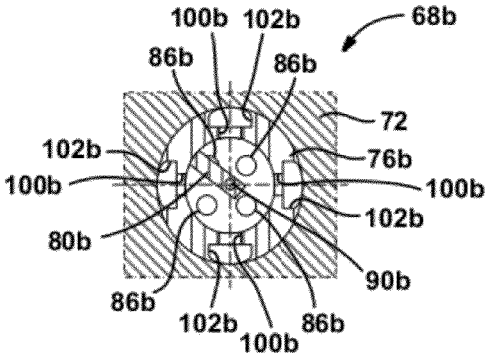
FIG. 6D is a bottom view of a pre-chamber spark plug including a gas thread cavity and a secondary gas cavity according to the present disclosure.

The secondary gas cavity 102*b* increases the capacity of the gas thread cavity 100*b* to contain burned gas present within the housing 76*b* when a spark 103*b* is generated between the center electrode 78*b* and the ground electrode 80*b*, as shown in FIG. 6A. The gas thread cavity 100*b* and the secondary gas cavity 102*b* may be axially aligned with the center electrode 78*b* and at least a portion of the ground electrode 80*b*. The secondary gas cavity 102*b* may have a U-shaped profile, as shown in FIGS. 6C and 6D.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spark plug, comprising:

a housing having a threaded portion configured to thread into a spark-plug hole in an engine;

a center electrode extending axially from a center of the housing;

a ground electrode extending radially inward from the housing; and a pre-chamber cup attached to the housing to define a pre-chamber, the housing defining a gas thread cavity that extends radially completely through the threaded portion of the housing.

2. The spark plug of claim 1, wherein the gas thread cavity includes N cylindrical cavities equally spaced around a perimeter of the housing, and N is an integer greater than one.

3. The spark plug of claim 2, wherein N is four.

4. The spark plug of claim 1, wherein the gas thread cavity is configured to contain burned gas present within the housing when a spark is generated between the center electrode and the ground electrode.

5. The spark plug of claim 1, wherein the center electrode has a first end and a second end opposite from the first end, the center electrode including a main body portion and a tip, the main body portion extending from the first end to the tip, the tip extending from the main body portion to the second end.

6. The spark plug of claim 5, wherein the main body portion of the center electrode extends into the pre-chamber a first distance and the gas thread cavity opens to the pre-chamber over a second distance, the second distance being generally equal to the first distance.

7. The spark plug of claim 6, wherein of the gas thread cavity is axially aligned with the main body portion of the center electrode.

8. The spark plug of claim 1, wherein the center electrode and the ground electrode are disposed within an upper one-half of the pre-chamber.

9. The spark plug of claim 8, wherein the center electrode and the ground electrode are disposed within an upper one-third of the pre-chamber.

10. The spark plug of claim 1, wherein the housing defines a secondary gas cavity in fluid communication with the gas thread cavity, the secondary gas cavity extending radially into the housing without extending through an inner surface of the housing.

11. The spark plug of claim 10, wherein the gas thread cavity has a U-shaped profile.

12. The spark plug of claim 10, wherein the gas thread cavity and the secondary gas cavity are axially aligned with the center electrode and at least a portion of the ground electrode.

13. The spark plug of claim 10, wherein the gas thread cavity and the secondary gas cavity are configured to contain burned gas present within the housing when a spark is generated between the center electrode and the ground electrode.

14. A spark plug, comprising:

a housing having a threaded portion configured to thread into a spark-plug hole in an engine;

a center electrode extending axially from a center of the housing, the center electrode including a main body portion and a tip;

a ground electrode extending radially inward from the housing; and a pre-chamber cup attached to the housing to define a pre-chamber, the housing defining a gas thread cavity that extends radially completely through the threaded portion of the housing, wherein the gas thread cavity is axially aligned with the main body portion of the center electrode, and the center electrode and the ground electrode are disposed within one-third of the chamber volume.

15. The spark plug of claim 14, wherein the gas thread cavity includes N cylindrical cavities equally spaced around a perimeter of the housing, and N is an integer greater than one.

16. The spark plug of claim 14, wherein the gas thread cavity is configured to contain burned gas present within the housing when a spark is generated between the center electrode and the ground electrode.

17. The spark plug of claim 14, wherein the main body portion of the center electrode extends into the pre-chamber a first distance and the gas thread cavity opens to the pre-chamber over a second distance, the second distance being generally equal to the first distance.

18. A spark plug, comprising:

a housing configured to thread into a spark-plug hole in an engine;

a center electrode extending axially from a center of the housing;

a ground electrode extending radially inward from the housing; and a pre-chamber cup attached to the housing, the housing and the pre-chamber cup defining a chamber volume, the housing defining a gas thread cavity and a secondary gas cavity in fluid communication with the gas thread cavity, the gas thread cavity extending radially completely through the housing, the secondary gas cavity extending radially into the housing without extending through an inner surface of the housing, wherein the gas thread cavity and the secondary gas cavity are axially aligned with the center electrode and at least a portion of the ground electrode, and the center electrode and the ground electrode are disposed within an upper one-third of the chamber volume.

19. The spark plug of claim 18, wherein the gas thread cavity and the secondary gas cavity are configured to contain burned gas present within the housing when a spark is generated between the center electrode and the ground electrode.

* * * * *